US009238952B2

(12) United States Patent
Rogers et al.

(10) Patent No.: US 9,238,952 B2
(45) Date of Patent: Jan. 19, 2016

(54) ANNULAR ISOLATION WITH TENSION-SET EXTERNAL MECHANICAL CASING (EMC) PACKER

(75) Inventors: Henry Eugene Rogers, Duncan, OK (US); Steven Lee Holden, Fletcher, OK (US); Frank V. Acosta, Duncan, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 644 days.

(21) Appl. No.: 13/115,281

(22) Filed: May 25, 2011

(65) Prior Publication Data

US 2012/0298380 A1 Nov. 29, 2012

(51) Int. Cl.
*E21B 33/12* (2006.01)
*E21B 33/128* (2006.01)
*E21B 33/129* (2006.01)

(52) U.S. Cl.
CPC ..... *E21B 33/12* (2013.01); *E21B 33/128* (2013.01); *E21B 33/1293* (2013.01)

(58) Field of Classification Search
CPC ..... E21B 23/02
USPC ..... 166/387, 179, 141, 180, 185, 140
See application file for complete search history.

(56) References Cited

U.S. PATENT DOCUMENTS

| | | | | |
|---|---|---|---|---|
| 2,884,071 | A * | 4/1959 | Fredd | 166/137 |
| 3,252,517 | A | 5/1966 | Lewis et al. | |
| 3,424,477 | A | 1/1969 | Putch et al. | |
| 3,603,390 | A * | 9/1971 | McGill | 166/196 |
| 3,946,807 | A | 3/1976 | Amancharla et al. | |
| 4,410,040 | A * | 10/1983 | Longacre et al. | 166/118 |
| 4,690,220 | A | 9/1987 | Braddick | |
| 4,836,278 | A * | 6/1989 | Stone et al. | 166/115 |
| 4,862,961 | A | 9/1989 | Neff | |
| 5,261,492 | A * | 11/1993 | Duell et al. | 166/387 |
| 5,474,127 | A | 12/1995 | White | |
| 6,318,472 | B1 | 11/2001 | Rogers et al. | |
| 6,810,958 | B2 | 11/2004 | Szarka et al. | |

(Continued)

FOREIGN PATENT DOCUMENTS

| | | | |
|---|---|---|---|
| GB | 2344838 | A | 6/2000 |
| WO | 2012160339 | A2 | 11/2012 |

OTHER PUBLICATIONS

Foreign communication from a related counterpart application—International Search Report and Written Opinion, PCT/GB2012/000470, Aug. 14, 2013, 10 pages.

*Primary Examiner* — William P Neuder
(74) *Attorney, Agent, or Firm* — John W. Wustenberg; Baker Botts L.L.P.

(57) ABSTRACT

An apparatus comprising a first casing string comprising one or more profiled seats furrowed into the first casing string's inner casing wall, a second casing string comprising an upper casing joint, a lower casing joint, and a tension-set external mechanical casing (EMC) packer positioned between the upper casing joint and the lower casing joint, wherein the tension-set EMC packer comprises a mandrel that is attached to the upper casing joint and to the lower casing joint, wherein the second casing string is disposed within the first casing string such that a casing casing annulus (CCA) is formed between the first casing string's inside diameter (ID) and the second casing string's outside diameter (OD), and wherein the recessed seats are positioned below the tension-set EMC packer prior to any engagement of the tension-set EMC packer with the first casing string.

15 Claims, 7 Drawing Sheets

(56) References Cited

U.S. PATENT DOCUMENTS

| | | | |
|---|---|---|---|
| 6,957,704 | B2 | 10/2005 | Rogers et al. |
| 7,290,612 | B2 | 11/2007 | Rogers et al. |
| 7,303,014 | B2 | 12/2007 | Reddy et al. |
| 7,322,412 | B2 | 1/2008 | Badalamenti et al. |
| 7,389,815 | B2 | 6/2008 | Badalamenti et al. |
| 7,404,440 | B2 | 7/2008 | Reddy et al. |
| 7,409,991 | B2 | 8/2008 | Reddy et al. |
| 7,451,817 | B2 | 11/2008 | Reddy et al. |
| 7,503,399 | B2 | 3/2009 | Badalamenti et al. |
| 7,866,392 | B2 | 1/2011 | Rogers et al. |
| 7,938,186 | B1 | 5/2011 | Badalamenti et al. |

* cited by examiner

ANNULAR ISOLATION WITH TENSION-SET EXTERNAL MECHANICAL CASING (EMC) PACKER

CROSS-REFERENCE TO RELATED APPLICATIONS

Not applicable

STATEMENT REGARDING FEDERALLY SPONSORED RESEARCH OR DEVELOPMENT

Not applicable.

REFERENCE TO A MICROFICHE APPENDIX

Not applicable.

BACKGROUND

Drilling procedures for hydrocarbon-producing wells often include lining the wellbore with one or more casings to provide structural integrity to the wellbore and/or to isolate various portions of the subterranean formation, e.g. groundwater reservoirs, pay zones, etc. Generally, wellbore casings are composed of a plurality of casing pipe segments (casing joints) that are attached to form a cylindrical casing string. The individual casing joints may be uniformly dimensioned such that each casing joint comprises a substantially identical length, outside diameter (OD), inside diameter (ID), and wall thickness, as well as other homogeneous characteristics, e.g. material strength (grade), weight, and end finish (e.g. threading, coupling, etc.). As such, a casing's length may be variable (e.g. depending on the number of casing joints), while the casing's diameter may be fixed (e.g. defined by the casing joints' uniform diameter which may range from about 2.5 to about 40 inches). Casing strings are typically assembled and installed in a piecemeal fashion by repeatedly coupling (e.g. threadably attaching) one casing joint to another casing joint and lowering the casing string into the wellbore, until the casing string has descended to a desired depth. Upon reaching the desired depth, the casing string may be fixed into place by conventional cementing techniques.

Many hydrocarbon-producing wells use a plurality of casings to isolate different formations at varying depths in the wellbore. For instance, a cased wellbore may comprise a surface casing for isolating a freshwater formation, an intermediate casing for isolating a potentially hazardous formation (e.g. a theft zone), and a production casing for isolating a producing formation (e.g. a pay zone). The wellbore's production casing may comprise a relatively small diameter pipe that is disposed within the intermediate casing and extends from the surface of the wellbore to a point at or below the targeted pay zone (e.g. to about the bottom of the wellbore). The wellbore's intermediate casing may comprise a somewhat larger diameter pipe that is disposed within the surface casing and extends from the surface of the wellbore to a point just below the hazardous formation (e.g. below the thief zone but above the pay zone). The wellbore's surface casing may comprise a relatively large diameter pipe that extends from the wellbore's surface to a point just below the freshwater formation. In some applications, the production casing may be dimensioned to accommodate production tubing and/or associated production equipment, while the intermediate casing may be dimensioned to accommodate the production casing, and the surface casing to accommodate the intermediate casing. In other applications, a wellbore's intermediate casing may have formerly been used as a "production casing" during the production of earlier pay zones, e.g. that have since been depleted. Hence, today's intermediate casing may have been yesterday's production casing. To avoid ambiguity, an interior casing may be referred to herein as a "child casing" and an exterior casing may be referred to herein as a "parent casing" (e.g. such that a child casing string is run within a parent casing string).

Once the child casing has been lowered to the desired depth within the parent casing, the child casing may be secured and/or fixed to the parent casing to stabilize the wellbore and prevent shifting of the child casing during subsequent drilling and/or production activities. Additionally, and to effectuate zonal isolation, the void and/or annulus formed between the child casing's outer wall and the parent casing's inner wall may be sealed to prevent "communication" between adjoining formations (i.e. to achieve zonal isolation). This void may be referred to herein as the casing casing annulus (CCA), and may serve a variety of functions during wellbore operations (e.g. providing an annular flow area to dispel cuttings and other debris).

An external casing packer (ECP) may be used alone or in conjunction with conventional cementing operations to seal the CCA and/or to fix the child casing string to the parent casing string. ECPs are typically composed of a mandrel encircled by a sealing element, but may also include various other components or features, e.g. packer shoes/collars, engagement assemblies, etc. The ECP's mandrel may be a specialty casing joint that is dimensioned similarly to the other casing joints within the child casing, and may be coupled directly into the child casing string such that the ECP comprises a link within the child casing string. The ECP may be strategically positioned within the child casing string such that the ECP can be set at the desired depth (e.g. when the ECP is said to be "on depth") as the lower end of the child casing approaches the bottom of the wellbore. Setting the ECP may cause the ECP's sealing element to expand outwardly against the parent casing's inner wall, thereby sealingly fixing the child casing to the parent casing.

When used in conjunction with conventional cementing operations, setting of the ECP may be one step in the cementing operation, and may serve to stabilize the child casing during and/or after the cementing operation (e.g. during curing periods). The ECP may also provide a secondary sealing function in the event of a leak in the primary cement sheath formed in the CCA. Specifically, splintering and/or fracturing of the cement sheath surrounding the child casing may occur due to shifting/movement of the casings during and/or after cementing operations. For instance, variations in temperature and/or pressure may cause the casings to expand and/or contract, thereby compromising the cement-casing bond and causing a microannulus to form between the casing and the cement sheath. In extreme cases, the microannulus may substantially encircle the child casing's OD, thereby allowing potential communication between isolation zones (e.g. absent a secondary annular seal). Hence, the ECP's annular seal may be critical to zonal isolation in some applications.

Conventional ECPs may come in two varieties, namely; (1) external inflatable casing packers (EICPs) that employ inflatable sealing elements and (2) external mechanical casing (EMC) packers that employ compressible sealing elements. Conventional EICPs may actuate their sealing element by pumping hydraulic fluid into an inflatable bladder that encircles the EICP'S mandrel. Notably, the hydraulic fluid is typically pumped down the child casing's ID and through holes (e.g. perforations) in the EICP's mandrel wall. The EICP's porous mandrel wall may be difficult to reliably seal after the bladder has been fully inflated, with even properly sealed holes being weaker than the surrounding solid steel casing wall. Hence, holes in the EICP's mandrel wall may constitute weak spots in the child casing, and may be susceptible to leaks for the life of the well. Conventional EMC packers actuate their sealing element by exerting a vertical mechanical force (a setting force) on the sealing element, thereby longitudinally compressing the sealing element such that it laterally swells into the CCA. The setting force may be exerted on the EMC packer's sealing element by applying a longitudinally-compressive (down-hole) force to the child casing string after the EMC packer has engaged the parent casing. Hence, compressible sealing elements may be actuated via kinetic energy transferred vertically through the child casing string, rather than hydraulic energy transferred through perforations in the mandrel wall (e.g. such is the case with EICPs).

Before being "set", conventional EMC packers must first engage an "internal upset" or landing in the parent casing (e.g. at or around the desired depth) that provides the necessary resistance to counteract the setting force and effectuate a compression of the EMC packer's sealing element. The "internal upset" may comprise a raised shoulder or some other restrictive protrusion that decreases the parent casing's ID and results in a diametrical constriction of the parent casing at or near the desired depth. Specifically, this diametrical constriction may capture a portion or component of the EMC packer (such as a lower packer shoe/collar), thereby "engaging" the EMC packer. Once captured, the lower packer shoe/collar may remain stationary in relation to the parent casing such that further displacement of the child casing causes the packer shoe to shear off (or otherwise become detached from the mandrel) and float along the mandrel's outer-wall. As the child casing is displaced further down-hole, the sealing element may be trapped between the floating lower packer shoe/collar and an upper packer shoe that remains fixed to the mandrel. Accordingly, the sealing element may become longitudinally-compressed as the distance between the upper and lower packer shoe decreases (e.g. in proportion to the child casing's displacement), causing the sealing element to swell outwardly into the CCA. Upon contacting the parent casing's inner wall, the sealing element may sealingly fix the child casing to the parent casing (at least presumably) for the life of the well.

Implementation of conventional EMC packers may have two functionally limiting characteristics, namely; (1) engaging of an "internal upset" in the parent casing and (2) being set "in compression". Firstly, the "internal upset" along the parent casing's interior casing wall acts to diametrically constrict the parent casing's ID at or near the "on depth" point, thereby adversely affecting the parent casing's flow characteristics (e.g. casing and/or annular flow rates during earlier production periods and/or drilling operations). Additionally, the "internal upset" may necessitate the use of specialty wellbore equipment (e.g. modified drill-bits, centralizers, under-reamers, etc.) that are capable of extending past the constricted portion of the parent casing, which may add additional expense and/or complexity to subsequent down-hole operations. Another consequence of the "internal upset" engagement design is that the EMC packer itself may (by definition) be incapable of extending past the constricted portion of the parent casing, and hence may have only one possible predefined "on depth point" (e.g. conventional EMC packers can only be set at one depth). As a result, applications employing conventional EMC packers may lack flexibility and may be unable to adapt to changing wellbore conditions that prevent the child casing from being run to the bottom of the wellbore. For instance, uncased portions of the wellbore may swell, shift, and/or become partially filled with debris (e.g. cuttings, etc) before the child casing is run. In such cases, the child casing may be prevented from extending to the absolute bottom of the drilled wellbore, and instead may only run substantially down the wellbore (e.g. 20, 40, or 60 meters from the wellbore bottom). Because the EMC packer is positioned within the child casing string relatively early on (e.g. long before the child casings practical/achievable setting depth is known), well architects may base their strategic positioning of the EMC packer on projected wellbore conditions. Hence, aggressively positioned EMC packers (e.g. assuming good wellbore conditions) may not reach the parent casing's "internal upset", while conservatively positioned EMC packers (e.g. assuming poor wellbore conditions) may reach the "internal upset" prematurely, thereby leaving a substantial portion of the wellbore "uncased".

Secondly, conventional EMC packers are generally set "in compression" by applying a compressive (down-hole) force to the child casing after engagement of the EMC packer. Casings set "in compression" may have significantly lower collapse ratings than casings that are set "in tension" by applying an up-hole force. A casing's collapse rating may correspond to the minimum external pressure (i.e. the differential pressure acting from the outside to the inside of the casing) required to catastrophically deform the casing, and thus may be indicative of a characteristic of the casing's durability. Specifically, a casing's collapse pressure may be proportional to the casing's material strength, which may vary along the casing's length according to an axial stress exerted on the casing at different wellbore depths (e.g. due to a buoyancy differential). Usually, a casing's critical collapse pressure is determined at the bottommost casing joint (i.e. towards the bottom of the wellbore, where hydrostatic pressure is generally greatest), and hence reducing axial stress applied on the lower portion of the casing string may increase the casing's practical robustness. Setting the casing "in compression" generally increases axial stress at the bottom of the casing string, while setting the casing "in tension" generally relieves axial stress at the bottom of the casing string. Hence, casings that are set "in compression" may be less durable and/or more prone to collapse than casings that are set "in tension". Additionally, compression-set EMC packers may require that the child casing have a minimum "string weight", and hence may be ill-suited for some applications. Specifically, a tensional (up-hole) force is normally applied to the casing string to counteract the casing's "string-weight" (i.e. the gravitational force acting on the child casing), and hence the exertion of a compression (down-hole) force (e.g. to set the EMC packer) generally comprises "letting off" of the tension (e.g. rather than actually pushing down on the casing) such that the casing's own "string weight" is allowed to carry it down-hole. In other-words, the available compressive (down-hole) force may be limited by the casing's "string weight", and thus relatively light casing strings may lack sufficient "string weight" to set some compression-set EMC packers. Thus, conventional (i.e. compression-set) EMC packers may not be suitable for applications in which the child casing's "string weight" is insufficient to compress their sealing elements.

Due to these and other limitations, a tension-set EMC packer whose engagement does not rely on an internal upset is needed.

SUMMARY

Disclosed herein is an apparatus comprising a first casing string comprising one or more profiled seats furrowed into the first casing string's inner casing wall, a second casing string comprising an upper casing joint, a lower casing joint, and a tension-set EMC packer positioned between the upper casing joint and the lower casing joint, wherein the tension-set EMC packer comprises a mandrel that is attached to the upper casing joint and to the lower casing joint, wherein the second casing string is disposed within the first casing string such that a CCA is formed between the first casing string's ID and the second casing string's OD, and wherein the recessed seats are positioned below the tension-set EMC packer prior to any engagement of the tension-set EMC packer with the first casing string.

Also disclosed herein is a method for sealing a CCA that is formed as a child casing string is disposed within a parent casing string, the method comprising exerting a first longitudinal down-hole force on the child casing string to displace the child casing string down-hole, wherein the child casing string comprises a tension-set EMC packer, detecting a first measurable force indicating that the tension-set EMC packer has engaged the parent casing string at a first on depth point, wherein the first measurable force counteracts the first longitudinal down-hole force such that the child casing string is prevented from being displaced further down-hole through exertion of the first longitudinal down-hole force alone, determining whether or not to set the tension-set EMC packer at the first on depth point, wherein the parent casing string and the child casing string both comprise an inner casing wall that is substantially devoid of any internal upsets such that each casing's ID is not substantially reduced at any point along the casing's continuous bore, and wherein no holes or perforations exist in the child casing string's inner casing wall such that the inner casing wall is substantially contiguous along the span of the child casing string.

DETAILED DESCRIPTION OF THE EMBODIMENTS

Figure 1:
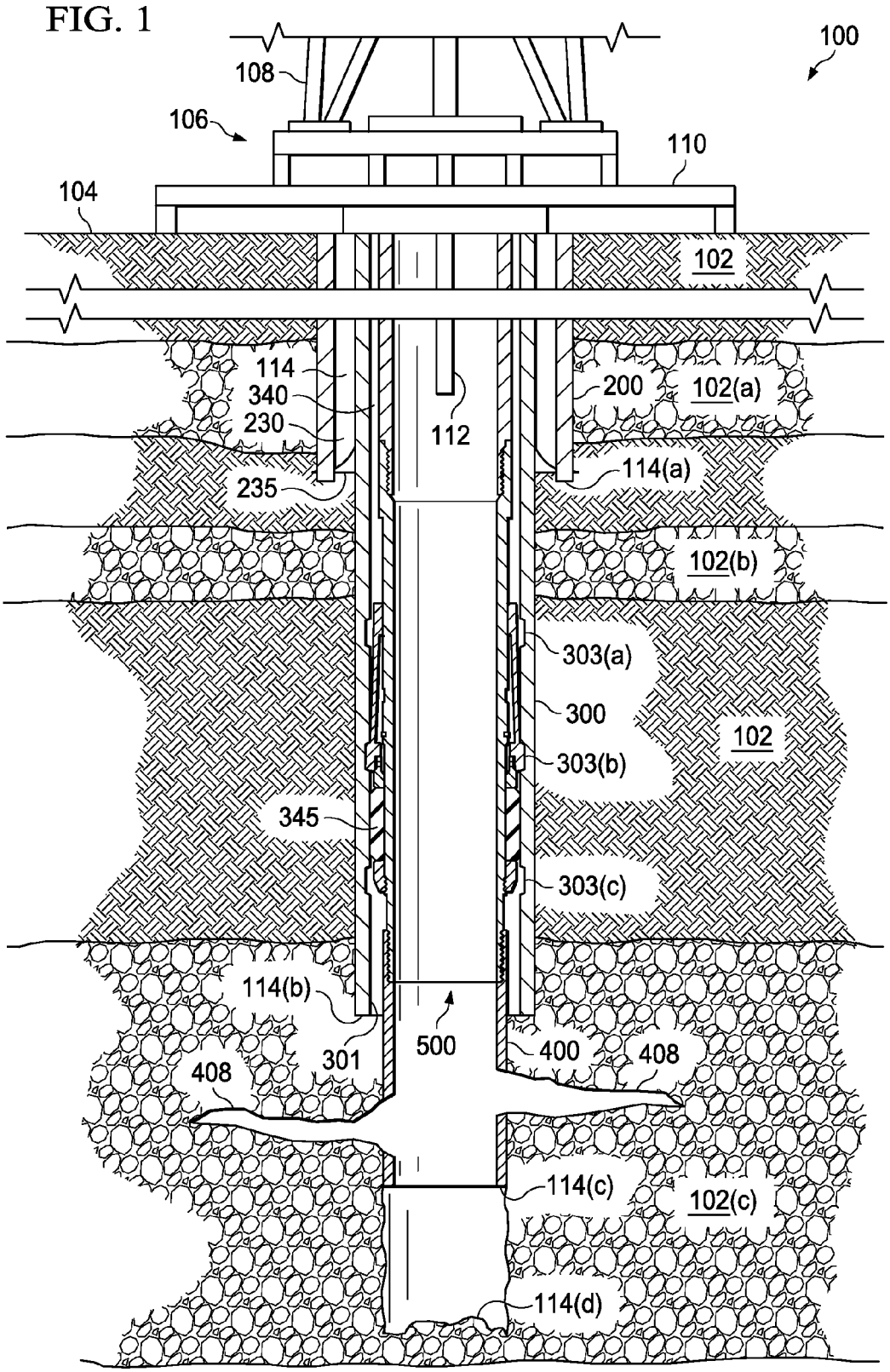
FIG. 1 is a simplified cutaway view of a wellbore servicing apparatus.

In the drawings and descriptions that follow, like parts are typically marked throughout the specification and drawings with the same reference numerals, respectively. The drawn figures are not necessarily to scale. Certain features of the invention may be shown exaggerated in scale or in somewhat schematic form and some details of conventional elements may not be shown in the interest of clarity and conciseness. The present invention may be implemented in embodiments of different forms. Specific embodiments are described in detail and are shown in the drawings, with the understanding that the present disclosure is to be considered an exemplification of the principles of the invention, and is not intended to limit the invention to that illustrated and described herein. It is to be fully recognized that the different teachings of the embodiments discussed infra may be employed separately or in any suitable combination to produce desired results.

Unless otherwise specified, any use of any form of the terms "connect," "engage," "couple," "attach," or any other term describing an interaction between elements is not meant to limit the interaction to direct interaction between the elements and may also include indirect interaction between the elements described. In the following discussion and in the claims, the terms "including" and "comprising" are used in an open-ended fashion, and thus should be interpreted to mean "including, but not limited to . . . . " Reference to up or down will be made for purposes of description with "up," "upper," "upward" or "upstream" meaning toward the surface of the wellbore and with "down," "lower," "downward," "down-hole," or "downstream" meaning toward the terminal end of the well, regardless of the wellbore orientation. The term "zone" or "pay zone" as used herein refers to separate parts of the wellbore designated for treatment or production and may refer to an entire hydrocarbon formation or separate portions of a single formation such as horizontally and/or vertically spaced portions of the same formation. The term "seat" as used herein may be referred to as a ball seat, but it is understood that seat may also refer to any type of catching or stopping device for an obturating member or other member sent through a work string fluid passage that comes to rest against a restriction in the passage. The various characteristics mentioned above, as well as other features and characteristics described in more detail below, will be readily apparent to those skilled in the art with the aid of this disclosure upon reading the following detailed description of the embodiments, and by referring to the accompanying drawings.

Disclosed herein is a method and apparatus for achieving improved annular isolation using a tension-set EMC packer that engages a "recessed seat" in the parent casing. Specifically, the tension-set EMC packer may engage a parent casing that is substantially free from "internal upsets" and may be set by applying a tension force to the child casing string. Accordingly, the tension-set EMC may achieve reliable annular isolation (in contrast to EICPs), without constricting flow characteristics in the parent casing or sacrificing durability in the child casing (e.g. in contrast to conventional compression-set packers). Further, the tension-set EMC packer may be manipulated to extend beyond a recessed groove in the parent casing (e.g. by applying an additional down-hole force to the child casing), and hence may selectively engage any one of a plurality of recessed grooves positioned at various depths in the parent casing. Consequently, applications employing the tension-set EMC packer disclosed herein may be more flexible (e.g. when compared to conventional EMC packers), and therefore better able to adapt to changing wellbore conditions. Lastly, setting of the tension-set EMC packer disclosed herein may not be substantially limited by the child casing's "string weight", and hence it may be well-suited to light "string weight" applications.

FIG. 1 depicts an exemplary operating environment of a hydrocarbon producing well 100. As depicted, the hydrocarbon producing well 100 comprises a drilling rig 106 that is positioned on the earth's surface 104 and extends over and around a wellbore 114 that penetrates a subterranean formation 102 for the purpose of recovering hydrocarbons. The drilling rig 106 may comprise a derrick 108 with a rig floor 110 through which a work string 112 extends downward from the drilling rig 106 into the wellbore 114. The derrick 108 may provide a supporting structure for various equipment, such as equipment used for lowering the casing into the wellbore.

The subterranean formation 102 may comprise a plurality of formations and/or isolation zones, such as a groundwater formation 102(*a*), a hazardous formation 102(*b*), and a producing formation 102(*c*). The groundwater formation 102(*a*) may be positioned below the surface 104 but above the hazardous formation 102(*b*), and may comprise one or more freshwater aquifers. The hazardous formation 102(*b*) may be positioned below the groundwater formation 102(*a*) but above the producing formation 102(*c*), and may comprise hazardous characteristics and/or materials. For instance, the hazardous formation 102(*b*) may contain petroleum-based liquids and other hydrocarbon contaminants whose displacement into the groundwater formation 102(*a*) may pollute the freshwater aquifers therein. Additionally or alternatively, the hazardous formation 102(*b*) may comprise a depleted and/or low-pressure zone (e.g. a thief zone) whose formation pressure is substantially below that of the producing formation 102(*c*) such that communication therewith may allow hydrocarbons to escape from the producing formation 102(*c*) into the hazardous formation 102(*b*). The producing formation 102(*c*) may be positioned below the hazardous formation 102(*b*), and may comprise one or more pay zones containing economically producible hydrocarbons. The wellbore 114 may be drilled into the subterranean formation 102 using any suitable drilling technique, and may extend from the surface 104 to a wellbore bottom 114(*d*). The wellbore 114 may be a partially or fully cased wellbore and may be lined with one or more casing strings, including (but not limited to) a surface casing sting 200, an intermediate casing string 300, and a production casing sting 400.

The surface casing string 200 may extend down the wellbore 114 from about the surface 104 to about a wellbore depth 114(*a*), which may be located at a depth within the formation 102 that is below the groundwater formation 102(*a*) but above the hazardous formation 102(*b*). The surface casing 200 may isolate the wellbore 114 from the groundwater formation 102(*a*). The intermediate casing string 300 may extend down the wellbore 114 from about the surface 104 to about a wellbore depth 114(*b*), which may be located at a depth within the formation 102 that is below the hazardous formation 102(*b*) but above the producing formation 102(*c*). The intermediate casing string 300 may isolate the wellbore 114 from the hazardous formation 102(*b*), and may be disposed within the surface casing string 300 such that a CCA 230 is formed between the surface casing and the intermediate casing. In an embodiment, the intermediate casing string 300 may comprise one or more components capable of generating an annular seal 235 of the CCA 230 to isolate the ground formation 102(*a*) from the hazardous formation 102(*b*). For instance, the intermediate casing string may have been initially intended as an intermediate casing, and hence may have been run economically using a conventional ECP packer to effectuate the annular seal 235. In other embodiments, the intermediate casing string may previously have been a production casing string, and hence may have been run optimally using the tension-set EMC packer (described in greater detail below) to effectuate the annular seal 235. The annular seal 235 typically comprises a sealant composition such as cement. In an embodiment, the intermediate casing string 300 may comprise one or more profiled seats 303 recessed within its inner casing wall 301. For instance, the intermediate casing string 300 may comprise profiled seats 303(*a*)-(*c*) that may be positioned at discrete points at or around the wellbore depth 114(*b*) and may constitute engagement points for a tension-set EMC packer 500 coupled within the production casing string 400. In an embodiment, the profiled seat 303 may comprise a continuous or discontinuous circumferential groove on the interior surface of the casing. In an embodiment, with the exception of the profiled seat 303, the intermediate casing string 300 may otherwise comprise a smooth bore ID. For instance, the inner casing wall 301 may be substantially devoid of "internal upsets" or restrictive protrusions that extend inward and/or otherwise decrease the ID of the intermediate casing string 300.

The production casing string 400 may extend down the wellbore 114 from about the surface 104 to about a wellbore depth 114(*c*), which may be located at a depth within or below the producing formation 102(*c*). The production casing string 400 may generally isolate the wellbore 114 from the producing formation 102(*c*), and may comprise a solid and/or contiguous casing wall up until completion of the hydrocarbon producing well 100 (e.g. at which time perforations 408 may be made in the production casing string 400 to allow fracturing of the producing formation 102(*c*) and/or production from the hydrocarbon producing well 100). The production casing string 400 may be disposed within the intermediate casing string 300 such that a CCA 340 is formed between the intermediate casing and the production casing. In an embodiment, the production casing string 400 may comprise a tension-set EMC packer 500 configured to generate an annular seal 345 of the CCA 340, thereby isolating the producing formation 102(*c*) from the hazardous formation 102(*b*). Specifically, the tension-set EMC packer 500 may be configured to selectively engage one of the profiled seats 303(*a*)-(*c*), and thereafter may be "set" by applying a tensional (up-hole) force to the production casing string 400. Methods and procedures for the selective engagement and setting of the tension-set EMC packer 500 are described in greater detail below.

Figure 2:
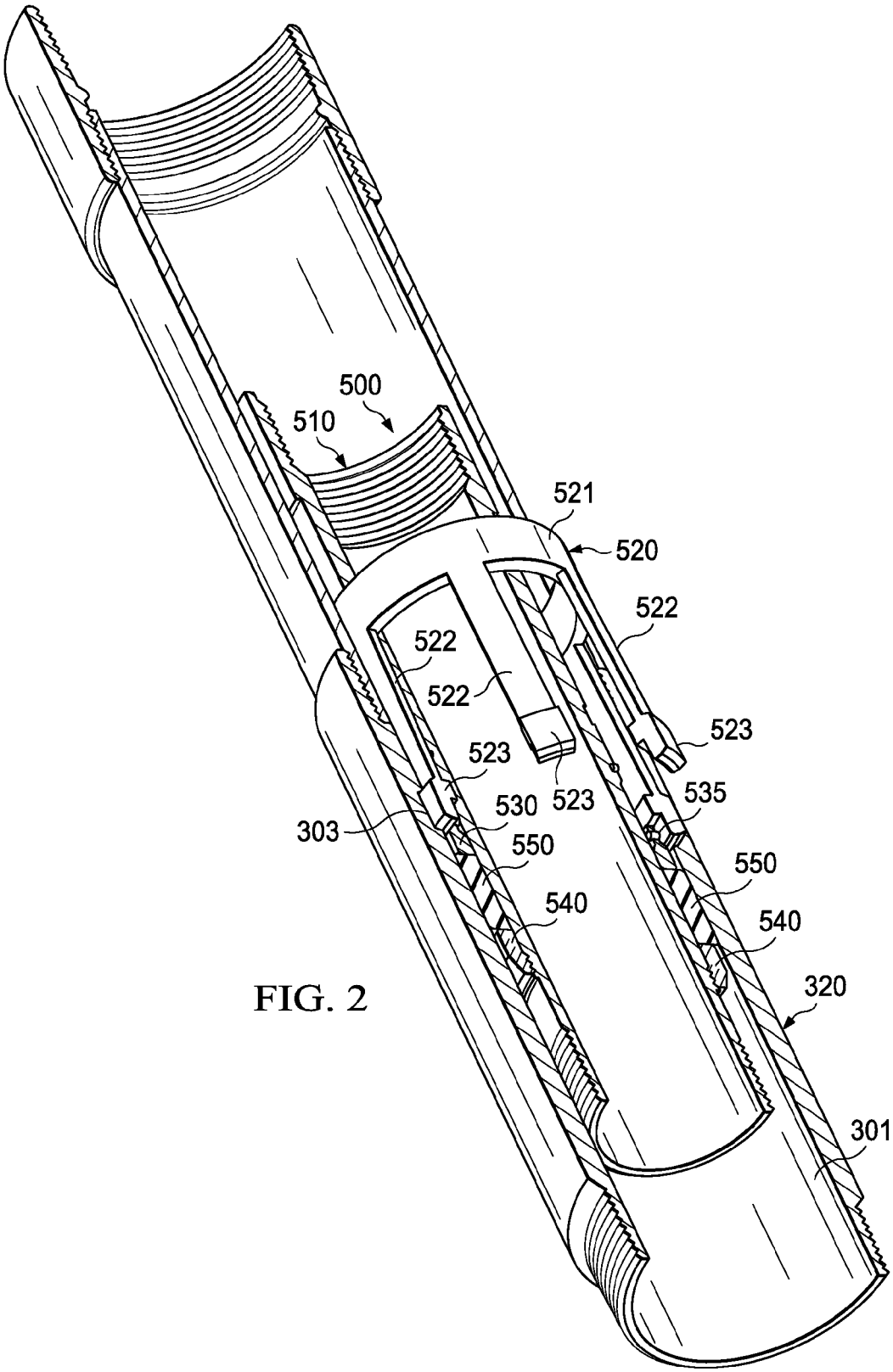
FIG. 2 is a simplified three-dimensional cross-sectional view of a tension-set external mechanical casing packer disposed within a parent casing.

FIG. 2 illustrates a three-dimensional cross-section of the tension-set EMC packer 500 engaged and set within a parent casing 320. Specifically, the parent casing 320 may comprise the section of intermediate casing string 300 that comprises the one or more profiled seats 303. The tension-set EMC packer 500 may comprise a mandrel 510, a split setting drag block assembly (DBA) 520, an upper packer shoe 530, a lower packer shoe 540, and a sealing element 550. The mandrel 510 may be attached to an upper casing joint and a lower casing joint of a child casing. Specifically, the child casing may comprise the section of the production casing string 400 that comprises the tension-set EMC packer 500, and hence a displacement of the child casing may correspond to a displacement of the production casing string 400. The mandrel 510 may be dimensioned so as to allow the child casing string to comprise an approximately uniform ID throughout. For instance, the mandrel 510 may comprise an ID that is substantially the same as that of the upper casing joint and the lower casing joint, and may comprise homogenous end finishings (e.g. upper and lower threadings) such that attachment thereto is seamlessly unobstructive to the flow characteristics of the child casing, e.g. does not meaningfully reduce the child casing's maximum flow rate. The split setting DBA 520 may comprise a plurality of machined features, such as a cylindrical base 521, one or more elastic fingers 522, and one or more profiled lugs or feet 523. Each of the profiled feet 523 may be attached to a corresponding one of the elastic fingers 522, which may extend down-hole from the cylindrical base 521. The elastic fingers 522 may be "split" or spaced to provide an annular flow area for the circulation and/or distribution of annular fluids (e.g. cement slurries, displacement fluid, etc.) and/or debris (e.g. cuttings, etc.) through the CCA 340 prior to setting the tension-set EMC packer 500 (i.e. prior to annular isolation). This annular flow area is further depicted in FIG. 3, where the annular gap between the cylindrical base 521 and the inner casing wall 301 is more clearly portrayed. The upper packer shoe 530 and the lower packer shoe 540 may comprise cylindrical collars that encircle the mandrel's 510 OD. The sealing element 550 may be composed of a non-porous material that is elastically enveloped around the mandrel's 510 OD and positioned between the upper packer shoe 530 and the lower packer shoe 540.

Figure 3:
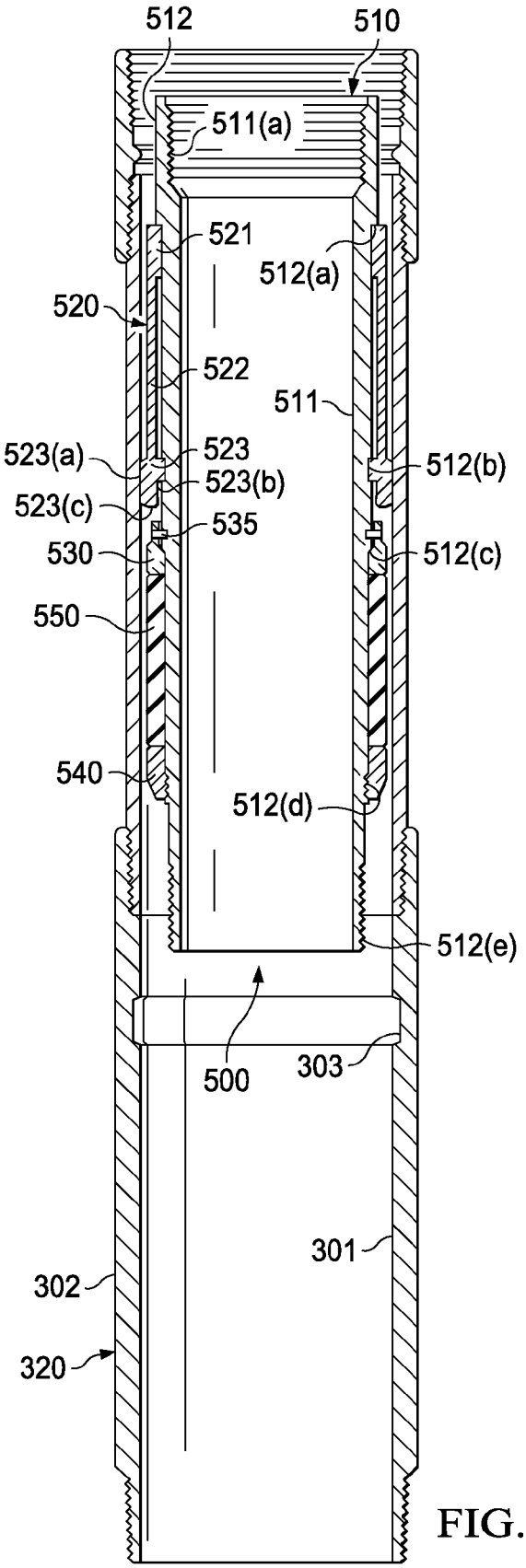
FIG. 3 is a simplified two-dimensional cross-sectional view of a tension-set external mechanical casing packer disposed within a parent casing.

FIG. 3 illustrates a two dimensional cross-section of the tension-set EMC packer 500 disposed within a parent casing 320. As shown, the parent casing 320 may comprise a smooth bore ID with the exception of the profiled seat 303. Put differently, the inner casing wall 301 may be substantially devoid of any "internal upsets" or restrictive protrusions that extend inward from the ID of the parent casing 320 such that the parent casing's 320 ID is approximately constant along the inner casing wall 301 except at the profiled seat 303, where the parent casing's 320 ID increases such that the flow characteristics (e.g. flow rate) of the parent casing 320 is not meaningfully restricted. Hence, the parent casing's 320 ID is not substantially constricted at any point along the inner casing wall 301.

The mandrel 510 may comprise an inner mandrel wall 511 and an outer mandrel wall 512. The inner mandrel wall 511 may comprise a recessed threading 511(*a*) that allows the mandrel 510 to be seamlessly attached to the upper casing joint, but may otherwise comprise a substantially constant ID that is substantially the same (e.g. about equal to) that of the upper casing joint and the lower casing joint. The outer mandrel wall 512 may comprise a plurality of machined features, including a first raised shoulder 512(*a*), a recessed seat 512(*b*), a second raised shoulder 512(*c*), a recessed shoe threading 512(*d*), and a recessed joint threading 512(*e*). In an embodiment, each of the external features 512(*a*)-(*e*) are furrowed into the outer mandrel wall 510 (rather than stamped/pressed into the mandrel 510) such that no evidence of the external features 512(*a*)-(*e*) (e.g. indentions or otherwise) are present at corresponding points along the inner mandrel wall 511.

The first raised shoulder 512(*a*) may face downwardly such that it normally abuts the trailing edge of the split setting DBA 520, whose cylindrical base 521 may closely encircle the mandrel's 510 OD. The cylindrical base 521 may comprise an appropriate thickness such that an annular gap exists between the cylindrical base 521 and the inner casing wall 301. The split setting DBA's 520 profiled feet 523 may comprise an outer profile 523(*a*) corresponding to the profiled seat 303, an inner profile 523(*b*) corresponding to the recessed seat 512(*b*), and a lower profile 523(*c*) corresponding to the upper packer shoe's 530 trailing edge. Accordingly, the elastic fingers 522 may extend down-hole from the cylindrical base 521, such that the inner profile 523(*b*) rests within the recessed seat 512(*b*) while the outer profile 523(*a*) is pressed flush against the inner casing wall 301. The elastic fingers 522 may be squeezed inwardly by a normal force applied against the outer profile 523(*a*) by the inner casing wall 301, causing the elastic fingers 522 to exert an outwardly bounding spring force on the profiled feet 523. Hence, the profiled feet 523 may be retained within the recessed seat 512(*b*) so long as the outer profile 523(*a*) is in direct contact with the inner casing wall 301, thereby allowing the split setting DBA 520 to be captured by mandrel 510 as the child casing is displaced in the wellbore. For practical purposes, the outer profile 523(*a*) may be said to be in "direct" contact with the inner casing wall 301 while the tension-set EMC packer 500 is not engaged with the parent casing 320. When the tension-set EMC packer 500 is engaged with the parent casing 320 (as described in greater detail below), the outer profile 523(*a*) may be said to be in "direct" contact with the profiled seat 303 (even though the profiled seat 303 is indeed furrowed into the inner casing wall 301, and may be referenced as a part thereof in other portions of this disclosure).

The second raised shoulder 512(*c*) may comprise a slight downward facing grade (e.g. an angled face) that mates against the upper packer shoe's 530 inner face, which may have a complementary profile or angle. Specifically, the upper packer shoe 530 may be pinned or otherwise affixed to the mandrel 510 via a shear pin 535, and may be at least partially buttressed by the second raised shoulder 512(*c*) as the child casing is displaced down-hole. Although a shear pin 535 is described herein, other types of fasteners and/or affixing mechanisms may be used in conjunction with, or alternatively to, the shear pin 535 for the purpose of affixing the upper packer shoe 530 to the mandrel 510. This partial support may reduce stress transferred to the shear pin 535 from incidental frictional forces (e.g. caused by passing annular fluids and debris), and prevent the upper packer shoe 530 from inadvertently shearing (i.e. prior to setting of the tension-set EMC packer 500, as described in greater below). The recessed shoe threading 512(*d*) may threadably fasten to the lower packer shoe 540, thereby substantially affixing the lower packer shoe 540 to the mandrel 510. The sealing element 550 may be adjoiningly and slideably interposed between the upper packer shoe 530 and the lower packer shoe 540 such that sealing element's 550 trailing edge abuts the upper packer shoe's 530 leading edge while the sealing element's 550 leading edge abuts the lower packer shoe's 540 trailing edge. The thickness of the upper packer shoe 530, the lower packer shoe 540, and the uncompressed sealing element 550 may be such that an annular gap exists between said components and the inner casing wall 301 before setting of the tension-set EMC packer 500 (as described in greater detail below).

Figure 4:
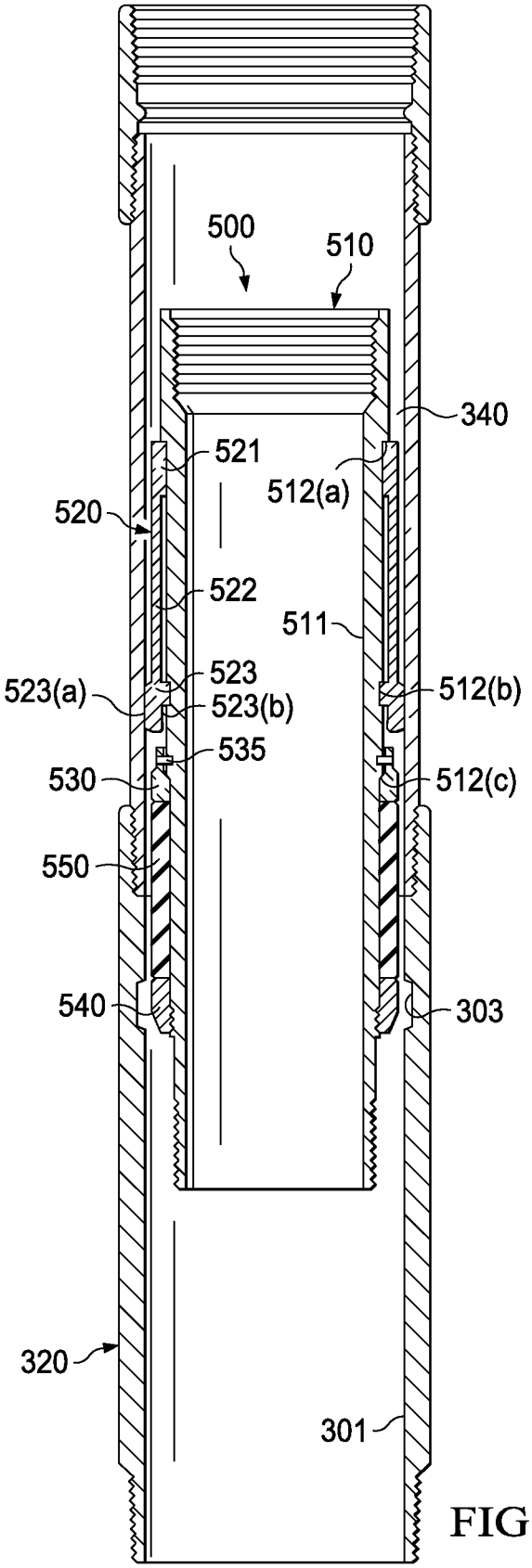
FIG. 4 is a simplified cross-sectional view of a yet to be engaged tension-set external mechanical casing packer disposed within a parent casing.
Figure 5:
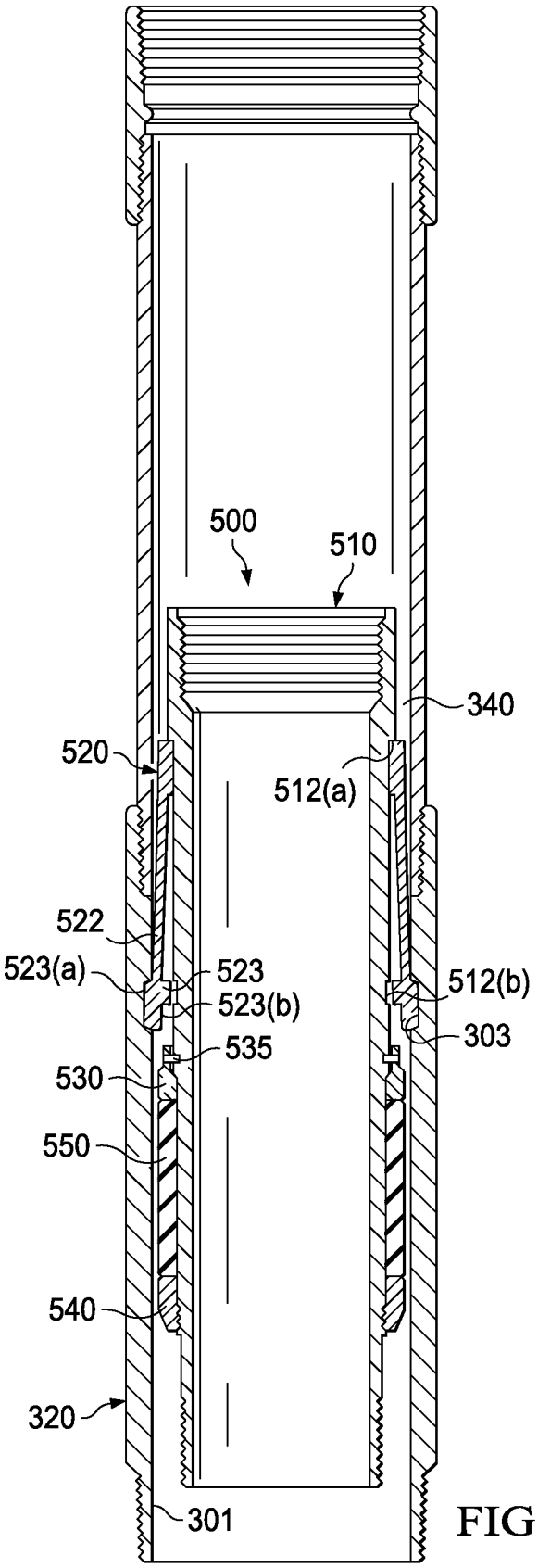
FIG. 5 is a simplified cross-sectional view of a tension-set external mechanical casing packer disposed and engaged within a parent casing.
Figure 6:
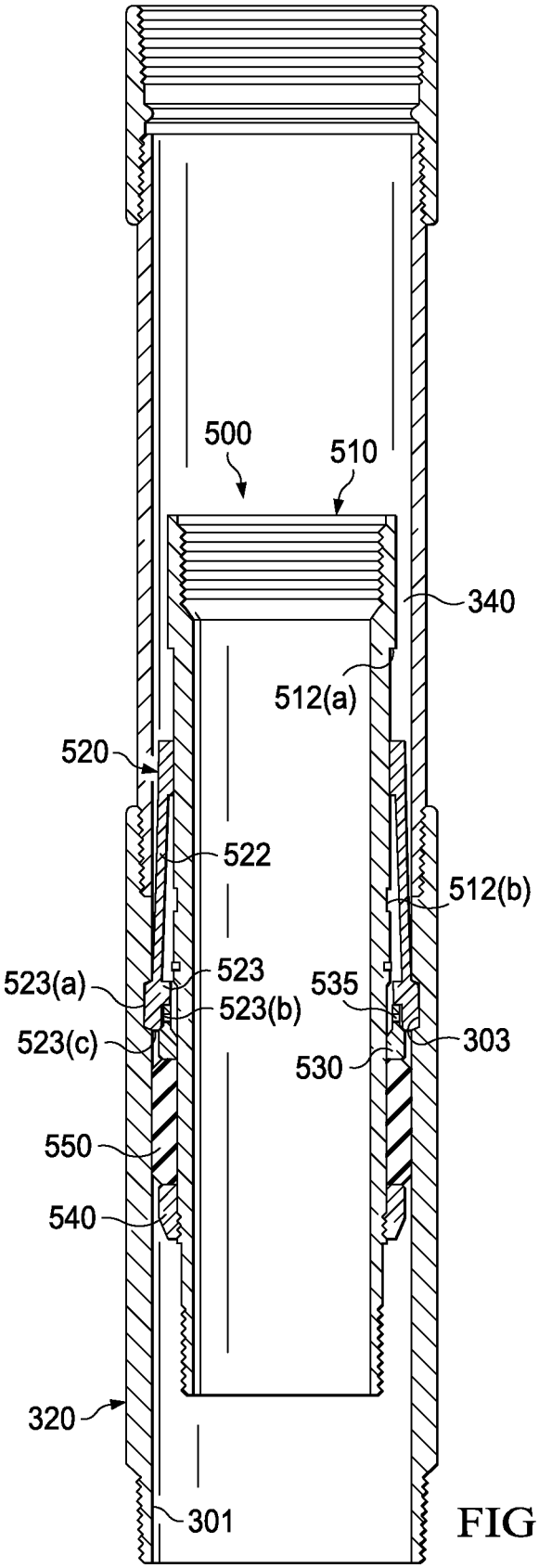
FIG. 6 is a simplified cross-sectional view of a tension-set external mechanical casing packer set within a parent casing.

FIGS. 4-6 cumulatively illustrate a sequence for "engaging" and "setting" the tension-set EMC packer 500 within the parent casing 320. FIG. 4 illustrates the tension-set EMC packer 500 just before reaching the profiled seat 303. As shown, the split setting DBA 520 remains captured by the mandrel 510 such that the profiled feet 523 remain retained within the recessed seat 512(*b*). At this point, the child casing string may be displaced in either direction (i.e. down-hole or up-hole) without setting the tension-set EMC packer 500. Specifically, if the child casing is displaced down-hole, the split setting DBA 520 may be primarily captured by the first raised shoulder 512(*a*), although it may also be secondarily retained by the recessed seat 512(*b*). Conversely, if the child casing is displaced up-hole, the split setting DBA 520 may be substantially retained (e.g. almost entirely retained) by the recessed seat 512(*b*).

Other features of the tension-set EMC packer 500 may be conducive for non-binding displacement within the parent casing 320. For instance, the lower packer shoe 540 may be positioned substantially flush against the sealing element 550, such that annular fluids and/or debris (e.g. cuttings) are largely prevented from wedging between the lower packer shoe's 540 trailing edge and the sealing element's 550 leading edge, thereby considerably shielding the sealing element 550 such that it is not inadvertently hung or bound on annular material (e.g. cuttings floating in the CCA 340) as the child casing string is displaced down-hole. Additionally, the upper packer shoe 530 may be positioned substantially flush against the sealing element 550, such that annular fluid and/or debris (e.g. cuttings) are largely prevented from wedging between the upper packer shoe's 530 leading edge and the sealing element's 550 trailing edge, thereby considerably shielding the sealing element 550 such that it is not inadvertently hung or bound on annular material (e.g. cuttings floating in the CCA 340) as the child casing string is displaced up-hole. Further, the dimensional thickness of the lower packer shoe 540 may be at least as great as that of the sealing element 550 and the upper packer shoe 530 to shield the respective components against premature compression and premature shearing as the child casing is displaced down-hole. In some embodiments, the lower packer shoe's 540 leading edge may be graded and/or profiled to shed and/or deflect annular materials as the child casing is displaced down-hole.

FIG. 5 illustrates the tension-set EMC packer 500 as it engages the parent casing 320. As shown, the profiled feet 523 may snap into the profiled seat 303 as the child casing reaches a desired depth (e.g. as the tension-set EMC packer 500 converges "on depth"), thereby allowing the profiled feet 523 to snap out of the recessed seat 512(*b*). Specifically, the outer profile 523(*a*) may slip over the profiled seat 303 as the tension-set EMC packer 500 converges "on depth" such that the outer profile 523(*a*) is no longer in direct contact with the inner casing wall 301, thereby removing (at least momentarily) the associated normal force that had previously served to retain the profiled feet 523 within the recessed seat 512(*b*). Accordingly, the elastic fingers 522 may be allowed to at least partially uncoil or unload, causing the profiled feet 523 to be laterally displaced such that their outer profile 523(*a*) is pressed into the profiled seat 303, thereby allowing their inner profile 523(*b*) to escape from the recessed seat 512(*b*). As such, the profiled feet 523 may now be retained by the profiled seat 303 (rather than the recessed seat 512(*b*)), and consequently the tension-set EMC packer 500 may become engaged with the parent casing 320.

Upon engagement of the tension-set EMC packer 500, the rig operator may observe a "measurable force" resisting the child casing's down-hole displacement, indicating that the tool is "on depth". To fully understand the "measurable force", it is helpful to first understand the different forces acting on the child casing when it is being Run-in-hole (RIH). A tensional (up-hole) force may be applied to counteract the child casing's "string weight" (i.e. the gravitational force acting on the child casing as it is suspended over the wellbore), and a partial relaxation (e.g. a "letting off") of that tensional force may allow the child casing to be displaced down-hole. Specifically, this "letting off" may result in a net downward force that is about equal to the difference between the "string weight" and the tensional forces exerted on the child casing string. The net down-hole force required to RIH prior to engagement of the tension-set EMC packer may be referred to herein as the "displacement force", and may comprise a force sufficient to overcome buoyancy and/or annular frictional forces resisting the child casings displacement down-hole. However, the "displacement force" may be insufficient to overcome the "measurable force" that results from the tension-set EMC packer 500 engaging the parent casing 320, and hence the "displacement force" alone may be insufficient to further displace the child casing down-hole after said engagement. Specifically, the "measurable force" may comprise a static frictional force resisting the child casing's down-hole displacement, and may correspond to an "engagement resistance" resulting from the profiled feet 523 being retained in the profiled seat 303. Observance of the "measurable force" may comprise the use of any conventional surface indication tool configured to measure the tensional, compressive, and/or net forces acting on a work/casing string.

Upon observance of the "measurable force", the rig operator may choose to either "set" or "disengage" the tension-set EMC packer 500 depending the wellbore conditions and/or operational objectives. For instance, the parent casing 320 may comprise multiple profiled seats 303 (e.g. 303(*a*) 303(*b*), . . . 303(*n*)), such that the tension-set EMC packer 500 can be selectively "set" at different wellbore depths. Accordingly, the casing may be RIH farther to engage one or more additional downhole seats 303. Alternatively, the parent casing 320 may comprise a single profiled seat 303, or the rig operator may have knowledge of wellbore conditions preventing extension of the child casing to the next deepest profiled seat 303.

Disengaging the tension-set EMC packer 500 may comprise applying a "disengagement force" to the child casing string to manipulate the tension-set EMC packer 500 beyond the profiled seat 303. Specifically, the "disengagement force" may comprise an additional longitudinal force that may be applied alone or in combination with the "displacement force" to overcome the "measurable force", thereby causing the profiled feet 523 to snap out of the profiled seat 303. As shown in FIG. 4, the profiled feet 523 and profiled seat 303 are contoured such that the outer profile's 523(*a*) leading edge is graded to match a corresponding grade of the profiled seat's 303 lower lip. These corresponding grades (e.g. slopes or angles) may allow the profiled feet 523 to gently snap out of the profiled seat 303 without binding in response to a downward (e.g. compressive force), thereby enabling the tension-set EMC packer 500 to disengage the parent casing 320 without damaging the elastic fingers 522. Notably, the profiled feet 523 may snap into the recessed seat 512(*b*) simultaneously (e.g. at about the same instance) as they snap out of the profiled seat 303 such that the elastic fingers 522 coil inwards. In some embodiments, the profiled feet 523 may only snap out of the profiled seat 303 so long as the recessed seat 512(*b*) is adjacently aligned with the inner profile 523(*b*).

Setting of the tension-set EMC packer 500 may comprise applying a "setting force" to the child casing string, as discussed below. However, some embodiments may comprise performing primary and/or secondary cementing operations before "setting" the tension-set EMC packer such that fluids (e.g. a cement slurry and/or displacement fluids) can be circulated/displaced within the CCA 340 prior to annular isolation. For instance, a cement slurry (e.g. along with displacement fluids, drilling mud, etc.) may be pumped through the child casing's ID such that at least some of the cement slurry is displaced through the bottom of the child casing and circulated/displaced back up through the CAA 340. In some embodiments, at least some of the cement slurry may be displaced beyond the sealing element 550 and into the upper-portion of the CCA 340. In some embodiments, the tension-set EMC packer 500 may then be "set" (e.g. before the cement has fully cured).

FIG. 6 illustrates the tension-set EMC packer 500 as it is set within the parent casing 320. Applying the "setting force" may comprise exerting a tensional (up-hole) force on the child casing string that is sufficient to overcome the casing's "string weight", as well as annular frictional forces and various "setting forces" that resist displacement of the child casing string up-hole. For instance, "setting forces" may occur at different points during the setting action, and may include the force required to severe the shear pin 535 as well as the force required to compress the sealing element 550. Displacement of the child casing string may result in a corresponding displacement of the mandrel 510, as well as the lower packer shoe 540, the sealing element 550, and (at least initially) the upper packer shoe 530. Notably, the profiled feet 523 may be retained by the profiled seat 303 such that the split setting DBA 520 may remain stationary and/or fixed in relation to the parent casing 320. Specifically, the profiled feet 523 may no longer be retained in the recessed seat 512(*b*), and hence the split setting DBA 520 may no longer be captured by the mandrel 510. Thus, the mandrel 510 may be displaced up-hole independently from the split setting DBA 520 during the setting action. As such, the split setting DBA 520 may float or slide along the mandrel's 510 OD such that the inner profile 523(*b*) is no longer adjacently aligned with the recessed seat 512(*b*), and consequently may not be disengaged by subsequent forces (e.g. such as setting forces resulting from shearing of the upper packer shoe 530 and/or compression of the sealing element 550).

As the mandrel 510 continues to be displaced up-hole, the upper packer shoe 530 may contact the profiled feet 523 such that the upper packer shoe's 530 trailing edge may become wedged in the lower profile 523(*c*). As a note, the upper packer shoe's 530 trailing edge was referenced supra during an earlier portion of this disclosure, during which time the child casing string was being displaced down-hole. The packer shoe's 530 trailing edge remains so termed (for purposes of consistency) even though it now leads the packer shoe 530 as the child casing is displaced up-hole. Further references of leading/trailing edges may use the same convention, such that a component's leading/trailing edge only leads/trails (respectively) the component as the child casing is displaced down-hole but is referenced as such at all times (i.e. even as the child casing is displaced up-hole). The upper packer shoe 530 may remain entrapped by the profiled feet 523 as the mandrel 510 is continuingly displaced up-hole, causing the shear pin 535 to severe such that the upper packer shoe 530 shears off from the mandrel 510. Upon shearing off, the upper packer shoe 530 may remain stationary and/or fixed in relation to the parent casing 320 such that the upper packer shoe 530 may float or slide along the mandrel's 510 OD in unison with the split setting DBA 520. As the mandrel 510 is continuingly displaced, the upper packer shoe 530 may float closer to the lower packer shoe 540 such the upper packer shoe's 530 leading edge exerts a longitudinal force on the sealing element's 550 trailing edge. The longitudinal force may work against a normal force exerted by the lower packer shoe's 540 trailing edge on the sealing element's 550 leading edge, thereby longitudinally compressing the sealing element 550 as the mandrel continues to be displaced. Such longitudinal compression of the sealing element 550 may cause it to swell outwardly into the CCA 340 and fill the annular gap between the sealing element 550 and the parent casing 320. Specifically, the sealing element 550 may be pressed firmly against inner casing wall 302 to generate the annular seal 345, and effectuate the annular isolation. In some embodiments, the rig operator may observe a second "measurable force" as the sealing element 550 is pressed firmly against the inner casing wall 302, indicating a successful annular isolation has resulted from the setting of the tension-set EMC packer 500.

Figure 7:
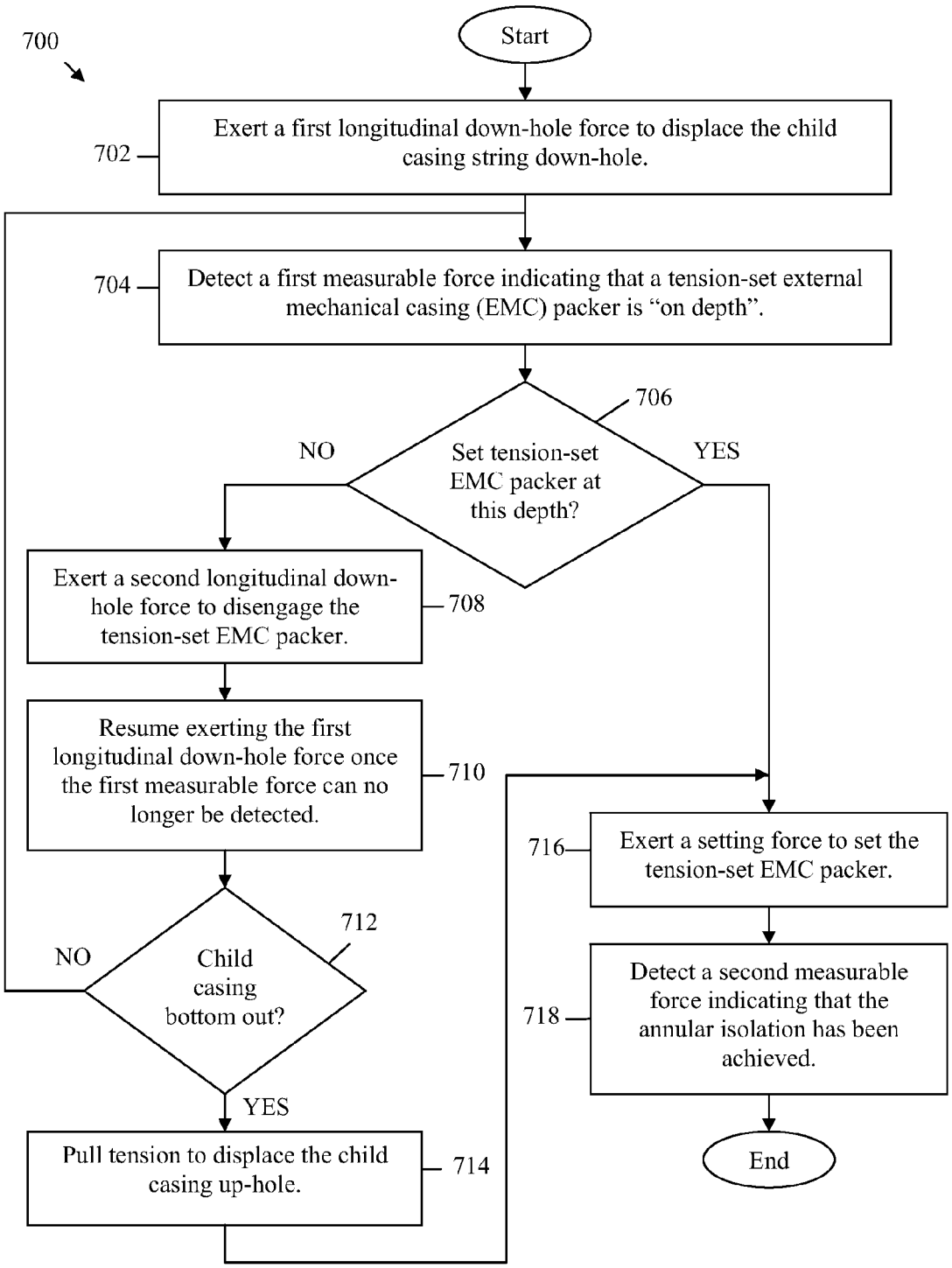
FIG. 7 is an embodiment of a method for achieving annular isolation.

FIG. 7 illustrates an embodiment of a method for achieving annular isolation 700. Step 702 may comprise exerting a first longitudinal down-hole force on a child casing to displace the child casing string down-hole. In an embodiment, exerting a first longitudinal down-hole force may comprise exerting a force no greater than a threshold force (e.g. a disengagement force), but may otherwise comprise exerting a range of forces depending on different wellbore conditions. For instance, a greater down-hole force may be required to overcome buoyant and/or other forces as the child casing is displaced deeper into the wellbore. Step 704 may comprise detecting a first measurable force indicating that a tension-set EMC packer is "on depth". Step 706 may comprise determining whether or not to set the tension-set EMC packer. If the rig operator decides to set the tension-set EMC packer at this depth, then the method may proceed to step 716 (discussed below). Otherwise (e.g. if the rig operator decides to disengage the tension-set EMC packer in hopes of reaching a deeper depth), the method may proceed to step 708. Step 708 may comprise exerting a second longitudinal force (e.g. a disengagement force) on the child casing to disengage the tension-set EMC packer. Step 710 may comprise resuming the exertion of the first longitudinal down-hole force once the first measurable force can no longer be detected. In an embodiment, failure to detect the first measurable force may indicate that the tension-set EMC packer has disengaged the parent casing. In another embodiment, resuming exertion of the first longitudinal down-hole force may instead be triggered by sensing a down-hole displacement of the child casing. Step 712 may comprise determining whether the child casing bottomed out (e.g. debris or other wellbore conditions prevented further down-hole displacement) before reaching the next deepest recessed seat. If the child casing does bottom out before reaching the next deepest recessed seat, then the method may proceed to step 714 (discussed below). If the child casing reaches the next deepest recessed seat before bottoming out, then the method may proceed to step 704 (discussed above).

Step 714 may comprise pulling tension on the child casing to displace the child casing up hole. Notably, the tension-set EMC packer may not be set (at least initially), as the split setting DBA may still be captured by the mandrel (i.e. the profiled feet are retained in the mandrel's recessed groove). After some displacement, the tension-set EMC packer may back into a recessed seat in the parent casing, and engage the parent casing. However, due to the child casing's upward displacement at the instance of engagement, the first measurable force may not be detected. Specifically, the engaged split setting DBA may float freely along the mandrel's OD during the child casing's upstroke, and hence may not provide the engagement resistance to trigger the first measurable force on the up-stroke.

Step 716 may comprise exerting a setting force to set the tension-set EMC packer. Specifically, the setting force may shear the upper packer shoe from the mandrel and compress the sealing element. If the tension-set EMC packer engages the parent casing's recessed seat on the down-stroke (i.e. while the child casing is being displaced down-hole), then the setting force may be applied in response to a setting decision (e.g. step 706) after detecting the first measurable force (e.g. step 704). Alternatively, if the tension-set EMC packer engages the parent casing's recessed seat on the up-stroke (i.e. while the child casing is being displaced up-hole), then the setting force may or may not be applied as a matter of course when pulling tension to displace the child casing up-hole (e.g. step 714). That is to say, that the setting force may or may not be insignificant (e.g. difficult to detect) in relation to the tensional force required to displace the child casing up-hole.

Step 718 may comprise detecting a second measurable force indicating that annular isolation has been achieved. For instance, the second measurable force may be associated with the sealing element expanding against the parent casing's wall and thereby filling the CCA.

In some embodiments, the decision (e.g. step 706) on whether to set the tension-set EMC packer may depend on various operational goals and/or wellbore conditions. For instance, if a primary operational goal is to minimize uncased portions of the wellbore, then the tension-set EMC packer may not be set until either (1) the tension-set EMC packer has reached the last recessed seat in the parent casing or (2) the child casing has cannot be run far enough down-hole to engage the tension-set EMC packer to the next deepest recessed seat in the parent casing (e.g. due to changed wellbore conditions). In the later instance, the rig operator may have initially disengaged the recessed seat only to reach the maximum achievable depth (step 712), at which time the child casing may be run up-hole until the tension-set EMC packer has been backed into the recessed seat (e.g. engages the recessed seat while being displaced up-hole).

While embodiments of the disclosure have been shown and described, modifications thereof can be made by one skilled in the art without departing from the spirit and teachings of the disclosure. The embodiments described herein are exemplary only, and are not intended to be limiting. Many variations and modifications of the disclosure disclosed herein are possible and are within the scope of the disclosure. Where numerical ranges or limitations are expressly stated, such express ranges or limitations should be understood to include iterative ranges or limitations of like magnitude falling within the expressly stated ranges or limitations (e.g. from about 1 to about 10 includes, 2, 3, 4, etc.; greater than 0.10 includes 0.11, 0.12, 0.13, etc.). For example, whenever a numerical range with a lower limit, $R_L$, and an upper limit, $R_U$, is disclosed, any number falling within the range is specifically disclosed. In particular, the following numbers within the range are specifically disclosed: $R=R_L+k*(R_U-R_L)$, wherein k is a variable ranging from 1 percent to 100 percent with a 1 percent increment, i.e. k is 1 percent, 2 percent, 3 percent, 4 percent, 5 percent, . . . 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. Use of the term "optionally" with respect to any element of a claim is intended to mean that the subject element is required, or alternatively, is not required. Both alternatives are intended to be within the scope of the claim. Use of broader terms such as comprises, includes, having, etc. should be understood to provide support for narrower terms such as consisting of, consisting essentially of, comprised substantially of, etc.

Accordingly, the scope of protection is not limited by the description set out above but is only limited by the claims which follow, that scope including all equivalents of the subject matter of the claims. Each and every claim is incorporated into the specification as an embodiment of the present disclosure. Thus, the claims are a further description and are an addition to the embodiments of the present disclosure. The discussion of a reference in the Description of Related Art is not an admission that it is prior art to the present disclosure, especially any reference that may have a publication date after the priority date of this application. The disclosures of all patents, patent applications, and publications cited herein are hereby incorporated by reference, to the extent that they provide exemplary, procedural, or other details supplementary to those set forth herein.

What is claimed is:

1. A wellbore servicing system comprising:

a first casing string cemented within a wellbore, wherein the first casing string comprises one or more profiled seats furrowed into an inner casing wall of the first casing string;

a second casing string fixed within the first casing string via a cement sheath and a tension-set external mechanical casing (EMC) packer such that a casing casing annulus (CCA) is formed between the first casing string's inside diameter (ID) and the second casing string's outside diameter (OD), wherein the cement sheath is disposed within at least a portion of the CCA, wherein the second casing string comprises an upper casing joint, a lower casing joint, and the tension-set EMC packer positioned between the upper casing joint and the lower casing joint, and wherein the tension-set EMC packer comprises a mandrel that is attached to the upper casing joint and to the lower casing joint; and wherein the tension-set EMC packer further comprises a split setting drag block assembly (DBA), an upper packer shoe, a lower packer shoe, and a sealing element positioned between the upper packer shoe and the lower packer shoe, wherein the upper packer shoe, the lower packer shoe, and the sealing element are positioned within the CCA, wherein the lower packer shoe is attached to the mandrel's OD, wherein the upper packer shoe is affixed to the mandrel's OD via a fastener, wherein the sealing element is enveloped around the mandrel's OD, and wherein the split setting DBA comprises a cylindrical base that encircles the mandrel's OD but is not fixably attached to the mandrel's OD, a plurality of elastic fingers extending down-hole from the cylindrical base; and a plurality of profiled feet extending down-hole from the elastic fingers, wherein the mandrel comprises an outer wall, the outer wall further comprising, a recessed groove positioned up-hole from the upper packer shoe, and a first raised shoulder positioned up-hole from the recessed groove, wherein the first raised shoulder faces down-hole and abuts the cylindrical base such that the split setting DBA is captured by the mandrel while the second casing is displaced down-hole; and wherein prior to engagement of the tension-set EMC packer with one of the profiled seats of the first casing string, the profiled feet are pressed firmly against the first casing string's inner casing wall such that the elastic fingers are squeezed inwardly, and wherein the profiled feet are configured to recede into the recessed groove so long as the profiled feet are in direct contact with the first casing string's inner casing wall.

2. The wellbore servicing system of claim 1, wherein both the inner casing wall of the first casing string and an inner casing wall of the second casing string are substantially devoid of any internal upsets such that each casing's ID is not substantially reduced at any point along the casing's continuous bore.

3. The wellbore servicing system of claim 2, wherein internal upsets comprise raised shoulders or any other protrusion that constricts the casing's ID.

4. The wellbore servicing system of claim 1, wherein prior to engagement of the tension-set EMC packer with one of the profiled seats of the first casing string, the split setting DBA is retained by the recessed groove when the second casing string is displaced up-hole.

5. The wellbore servicing system of claim 4, wherein upon engagement of the tension-set EMC packer with one of the profiled seats of the first casing string, the profiled feet are configured to snap into one of the profiled seats such that the split setting DBA is retained by the profiled seat, and wherein responsive to snapping into the profiled seat, the profiled feet snap out of the recessed groove such that the split setting DBA is no longer retained by the recessed groove.

6. The wellbore servicing system of claim 5, wherein subsequent to engagement, the tension-set EMC packer is configured to be set by exerting a tensional force to the second casing string.

7. The wellbore servicing system of claim 6, wherein exerting the tensional force causes the upper casing joint, the mandrel, the sealing element, the lower packer shoe, and the lower casing joint to be displaced upwardly in relation to the first casing string, wherein the split setting DBA remains stationary in relation to the first casing string, and wherein the upper packer shoe moves upward in relation to the first casing string until coming into contact with the split setting DBA.

8. The wellbore servicing system of claim 7, wherein the fastener is configured to shear or otherwise unfasten when the upper packer shoe comes into contact with the split setting DBA causing the upper packer shoe to shear off from the mandrel, and wherein subsequent to shearing off from the mandrel, the upper packer shoe remains stationary in relation to the first casing string.

9. The wellbore servicing system of claim 8, wherein subsequent to the shearing or unfastening of the fastener, further displacement of the second casing string causes the lower packer shoe to draw nearer to the upper packer shoe such that the sealing element becomes longitudinally compressed, wherein longitudinal compression of the sealing element causes the sealing element to swell outwardly into the CCA such that an annular isolation is achieved, and wherein the annular isolation comprises isolating an upper portion of the CCA that is positioned adjacent to and above the upper casing joint from a lower portion of the CCA that is positioned adjacent to and below the lower casing joint.

10. A method for sealing a casing casing annulus (CCA) that is formed as a child casing string is fixed within a parent casing string via a tension-set external mechanical casing (EMC) packer, the method comprising:

exerting a first longitudinal down-hole force on the child casing string to displace the child casing string down-hole, wherein the child casing string comprises an upper casing joint, a lower casing joint, and the tension-set external mechanical casing EMC packer, wherein the tension-set EMC packer comprises a mandrel that is attached to the upper casing joint and to the lower casing joint;

detecting a first measurable force indicating that the tension-set EMC packer has engaged the parent casing string at a first on depth point, wherein the first measurable force counteracts the first longitudinal down-hole force such that the child casing string is prevented from being displaced further down-hole through exertion of the first longitudinal down-hole force alone;

determining whether or not to set the tension-set EMC packer at the first on depth point, performing a cementing operation before the tension-set EMC packer is set but after the tension-set EMC packer is engaged with the parent casing string, wherein the cementing operation comprises pumping cementing fluid down through the child casing string's ID and out the end of the child casing string such that at least some of the cementing fluid is distributed back up through the CCA, and wherein at least some of the cementing fluid that is displaced into the CCA travels up past the tension-set EMC packer;

exerting a tensional force on the child casing string to set the tension-set EMC packer subsequent to performing the cementing operation, wherein setting the tension-set EMC packer comprises displacing the child casing string up-hole while the tension-set EMC packer is engaging the parent casing string;

detecting a second measurable force indicating that the tension-set EMC packer has been set, wherein the second measurable force counteracts the tensional force such that the child casing string is prevented from being displaced further up-hole through exertion of the tensional force alone; and exerting a second longitudinal down-hole force on the child casing string to disengage the tension-set EMC packer, wherein the combination of the second longitudinal down-hole force and the first longitudinal down-hole force is sufficient to overcome the first measurable down-hole force such that the child casing is displaced further down-hole; and discontinuing the exertion of the second longitudinal down-hole force once the first measurable force can no longer be detected, wherein failing to detect the first measurable force indicates that the tension-set EMC packer has disengaged the parent casing string such that the child casing string can be displaced further down-hole by exertion of the first longitudinal down-hole force alone wherein the parent casing string and the child casing string both comprise an inner casing wall that is substantially devoid of any internal upsets such that each casing's internal diameter (ID) is not substantially reduced at any point along the casing' continuous bore, wherein the parent casing string is cemented within a wellbore;

wherein the tension-set EMC packer further comprises a split setting the drag block assembly (DBA), an upper packer shoe, a lower packer shoe, and a sealing element positioned between the upper packer shoe and the lower packer shoe, wherein the upper packer shoe, the lower packer shoe, and the sealing element are positioned within the CCA, wherein the lower packer shoe is attached to the mandrel's OD, wherein the upper packer shoe is affixed to the mandrel's OD via a fastener, and wherein the sealing element is enveloped around the mandrel's OD; and wherein tension-set EMC packer is not set at the first on depth point.

11. The method of claim 10 further comprising:

detecting the first measurable force for a second time indicating that the tension-set EMC packer has engaged the parent casing string at a second on depth point;

exerting a tensional force on the child casing string to set the tension-set EMC packer at the second on depth point; and detecting a second measurable force indicating that the tension-set EMC packer has been set at the second on depth point.

12. The method of claim 10 further comprising:

determining that wellbore conditions prevent the child casing string from being displaced further down-hole, wherein the determination is made before the tension-set EMC packer has engaged the parent casing string at a second on depth point;

exerting a tensional force on the child casing string to displace the child casing string up-hole, wherein the tension-set EMC packer is not engaged with the parent casing string when the tensional force is initially exerted; and detecting a second measurable force indicating that the tension-set EMC packer has been set at the first on depth point, wherein the second measurable force counteracts the tensional force such that the child casing string is prevented from being displaced further up-hole through exertion of the tensional force alone.

13. The method of claim 12, wherein the EMC packer engages the parent casing string at the first on depth point after the tensional force is initially exerted but before the second measurable force is detected.

14. The method of claim 13, wherein the first measurable force is not detected when the tension-set EMC packer engages the parent casing string upon exertion of the tensional force to the child casing string.

15. The method of claim 10, wherein no holes or perforations exist in the child casing string's inner casing wall such that the inner casing wall is substantially contiguous along the span of the child casing string.

* * * * *